United States Patent [19]

Gilano

[11] 4,164,634

[45] Aug. 14, 1979

[54] KEYBOARD SWITCH ASSEMBLY WITH MULTIPLE ISOLATED ELECTRICAL ENGAGEMENT REGIONS

[75] Inventor: Michael N. Gilano, Newport Beach, Calif.

[73] Assignee: Telaris Telecommunications, Inc., Irvine, Calif.

[21] Appl. No.: 805,346

[22] Filed: Jun. 10, 1977

[51] Int. Cl.[2] ..... H01H 13/70

[52] U.S. Cl. ..... 200/5 A; 200/86 R; 200/159 B; 200/275

[58] Field of Search ..... 200/159 B, 5 R, 5 A, 200/86 R, 1 R, 275, 340, 302

[56] References Cited

U.S. PATENT DOCUMENTS

| | | | |
|---|---|---|---|
| Re. 28,365 | 3/1975 | Brave | 200/159 B X |
| 1,775,755 | 9/1930 | Forman | 200/86 R |
| 1,776,992 | 9/1930 | Brockman | 200/86 R |
| 3,056,005 | 9/1962 | Larson | 200/86 R |
| 3,165,606 | 1/1965 | Cooper | 200/86 R |
| 3,396,252 | 8/1968 | Serizawa et al. | 200/86 R |
| 3,699,294 | 10/1972 | Sudduth | 200/159 B X |
| 3,723,673 | 3/1973 | Clary et al. | 200/5 A X |
| 3,745,287 | 7/1973 | Walker | 200/159 B |
| 3,830,991 | 8/1974 | Du Rocher | 200/86 R |
| 3,860,771 | 1/1975 | Lynn et al. | 200/5 A |
| 4,090,045 | 5/1978 | Marsh | 200/5 A |

FOREIGN PATENT DOCUMENTS

| | | | |
|---|---|---|---|
| 2335907 | 1/1975 | Fed. Rep. of Germany | 200/159 B |
| 1253380 | 1/1961 | France | 200/86 R |
| 2268342 | 12/1975 | France | 200/159 B |

*Primary Examiner*—James R. Scott

*Attorney, Agent, or Firm*—Fraser and Bogucki

[57] ABSTRACT

A switch assembly includes an array of switches arranged on a substrate having a conductive pattern on a surface thereof defining a plurality of switch contacts. An apertured spacer is disposed adjacent the surface with an aperture being positioned in opposed relationship to each switch contact. A multi-conductive contact material is disposed to provide switch closure when forced through an aperture in the separator into engagement with a switch contact at a large number of separate conductive engagement regions. In one arrangement the multi-conductive contact material is a fine mesh woven wire screen stretched taut adjacent the separator while in another arrangement it is a uniaxially conducting material having a high density of parallel, spaced conductors extending perpendicular to the surface.

10 Claims, 3 Drawing Figures

KEYBOARD SWITCH ASSEMBLY WITH MULTIPLE ISOLATED ELECTRICAL ENGAGEMENT REGIONS

BACKGROUND OF THE INVENTION

1. Field of the Invention

This invention relates to a batch fabricated multiple element keyboard switch assembly and more particularly to such an assembly providing electrical contact closure at a plurality of separate conductive engagement regions.

2. Discussion of the Prior Art

In order to be competitive in a high volume market such as the calculator market of the Touch-Tone telephone market a keyboard switch assembly must satisfy a large number of conflicting demands. It must be compact, lightweight, very inexpensive, and highly reliable and have a satisfying touch to the operator. While electronic debouncing circuits are available, the economics of a particular use or the requirements of a particular customer frequently necessitate the use of a bounce-free switch assembly. That is, a single, unambiguous contact closure signal is required for each activation of a keyboard key. This problem of providing bounce-free operation becomes worse in multi-pole switch assemblies such as arrangements wherein a single key actuation must connect separate row and column conductors to a common voltage.

A variety of keyboard switch assembly arrangements have been developed in an attempt to meet the demands of the keyboard market. These include arrangements described in the following U.S. Pat. Nos. 3,699,294 to Suddath, 3,707,609 to Dupont et al, 3,780,237 to Seeger, Jr. et al, and 3,860,771 to Lynn et al.

Such arrangements teach the use of batch fabricated keyboard switch assemblies with switch contacts printed on substrates and with flexible protrusions or bubbles, sometimes used in combination with springs to improve switch characteristics. Nonetheless, further improvements in switch characteristics, and particularly elimination of switch bounce remain as goals to be sought.

SUMMARY OF THE INVENTION

A batch fabricated keyboard switch assembly in accordance with the invention includes a substrate having a conductive circuit pattern on a surface thereof to define switch contacts at separate switch contact regions of the substrate, a generally planar, non-conductive, relatively thin spacer disposed adjacent the surface of the substrate and having apertures therethrough at locations opposite the switch contact regions of the substrate to provide communication through the spacer to the switch contacts, a generally planar layer of resilient multiple conductive contact material disposed adjacent the spacer to electrically engage each of the switch contacts at a switch contact region at a large number of separate, isolated electrical engagement regions when forced through an aperture of the spacer into engagement with the switch contacts, the resiliency of the multiple conductive contact material providing a positional bias tending to oppose engagement with the switch contacts, a protective layer disposed adjacent the multi-conductive contact material, and an actuator disposed to force the multiple conductive contact material into switch closure engagement with a set of switch contacts in response to operator actuation.

Different configurations of the multi-conductive contact material include a fine mesh woven wire stainless steel screen having a resiliency which permits it to be stretched taut across the spacer apertures and a uniaxially conducting material including resilient dielectric material and a high density of spaced, parallel conductors disposed within the resilient dielectric material. The large number of individual conductive switch closure contact regions combine with the biased return resiliency of the multi-conductive contact material to provide an excellent combination of switch closure reliability, minimum switch bounce and low cost. Spring loading or a bubble protrusion may be utilized to provide an excellent human factor touch including a force-position hysteresis which further improves bounce characteristics.

BRIEF DESCRIPTION OF THE DRAWINGS

A better understanding of the invention may be had from a consideration of the following detailed description taken in conjunction with the accompanying drawings in which.

DETAILED DESCRIPTION

Figure 1:
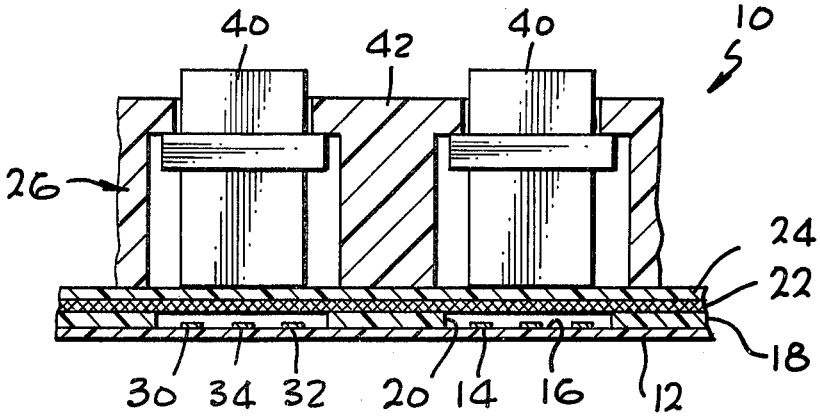
FIG. 1 is a cross-sectional view of a keyboard switch assembly in accordance with the invention.

As shown in FIG. 1, a keyboard switch assembly 10 in accordance with the invention includes a substrate 12 having a circuit pattern 14 defining switch contacts printed in switch regions of a surface 16 thereof, a dielectric spacer 18 having apertures 20 in the switch regions disposed adjacent the surface 16 in fixed non-moving relationship thereto, a fine, woven wire mesh screen 22 of a non-corrosive material such as stainless steel disposed adjacent the spacer 18 on a side thereof opposite the surface 16, a planar protective layer 24 disposed adjacent the screen 22 on a side thereof opposite the spacer 18 and an actuator assembly 26. It should be appreciated that the thicknesses of the various planar elements of the switch assembly have been shown exaggerated for convenience of illustration. For example, the substrate 12 may be Mylar or other polyester film with a thickness of 1 to 12 mils or other suitable material with a printed circuit pattern 14 defined thereon. The printed circuit pattern in this particular arrangement includes a column conductor 30, a row conductor 32 and a common conductor 34 with switch closure providing electrical connection between all three conductors to indicate a row and column at which a key actuation occurs. The spacer 18 may be a thin sheet of Mylar or other suitable dielectric material having a thickness at least several mils greater than the height of the printed conductor pattern 14 above the surface 16 of substrate 12, so that as the screen 22 is stretched taut across apertures 20 it remains out of contact with the switch contact patterns of conductors 30, 32 and 34.

The screen 22 may be any suitable fine wire woven mesh screen of a non-corrosive material such as stainless steel. It has been found that preferred performance occurs with a mesh size between 125 and 350 lines per inch and that best performance occurs with a mesh size of approximately 250 lines per inch. The weaving of the screen wires causes them to bend somewhat relative to the plane of the screen and thus provide the screen 22 with a certain resiliency in the plane of the screen. Therefore, as an actuator key 40 is moved downward in response to operator actuation, a force is exerted through the protective layer 24 and against the screen 22, thereby causing the screen to yield resiliently and to move into contact with the switch contact conductors 14 and provide a switch closure. Because of the resiliency of the screen and the multiple conductive contact points resulting from the weaving of the screen wire, the screen engages the switch contacts 30, 32 and 34 at a large number of separate and isolated electrical engagement regions to provide secure and reliable switch closure. Furthermore, because of the combination of the multiple contact closure points and the resiliency of the screen 22, which opposes the switch closure force, nearly bounce-free switch operation is achieved even with a difficult multiple switch contact configuration. The protective layer 24 may be a sheet of Mylar or other thin flexible material and may be adhered to the screen 22. A cover plate 42 may be ultilized to mechanically position the actuator keys 40 over the switch contact region of the surface 16. The entire switch assembly may be ruggedly secured as a single unit by screws, rivets or other conventional means which are not shown.

Figure 2:
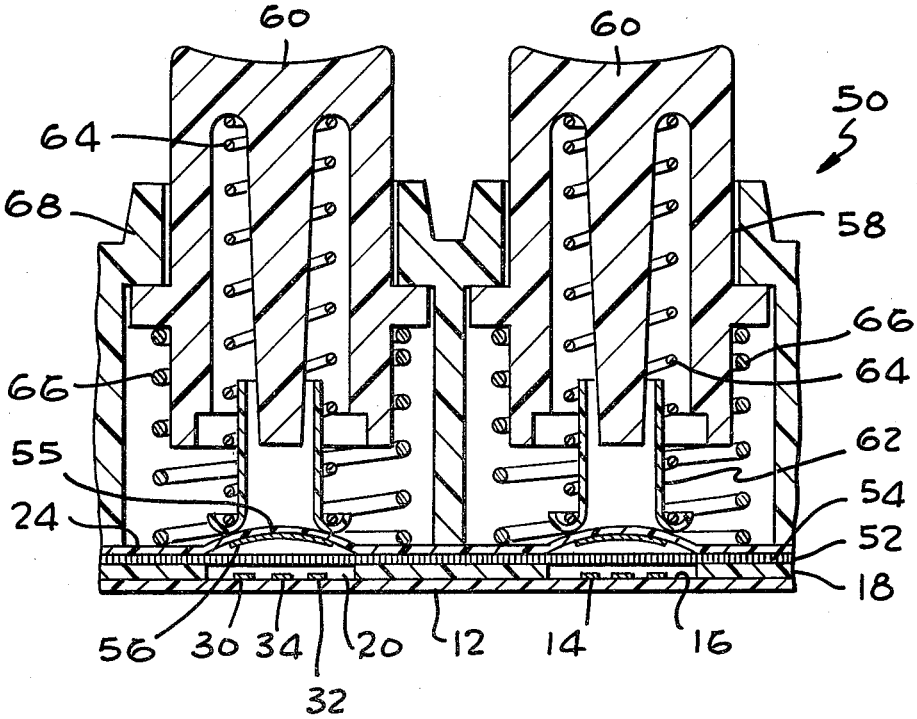
FIG. 2 is a cross-sectional view of an alternative arrangement of a keyboard switch assembly in accordance with the invention.

In an alternative arrangement of a keyboard switch assembly 50 in accordance with the invention which is shown in FIG. 2, the substrate 12 with a printed circuit switch contact pattern 14 printed on a surface 16 thereof is retained and the spacer 18 is disposed adjacent the surface 16 with apertures 20 at switch contact regions thereof to provide communication through the spacer 18 to the switch contacts 14. In this arrangement a layer of multi-conductive contact material in the form of a uniaxially conductive material 52 is disposed adjacent the spacer 18 on a side thereof opposite the surface 16 and extends across the apertures 20. The uniaxially conductive material 52 is a planar layer of a resilient dielectric material 53 having a high density of parallel spaced copper conductors 54 extending therethrough in a direction perpendicular to the plane of surface 16. The conductors 54 of uniaxially conductive material 52 have a slight spiral about an axis perpendicular to surface 16 to provide a small amount of compressible resiliency in the perpendicular direction. The uniaxially conductive material is commercially available from Teknit as R.F.I. gasket material having silicon rubber laden with conductive copper wires. This material provides an hermetic seal that is electrically conductive only in the transverse direction.

Figure 3:
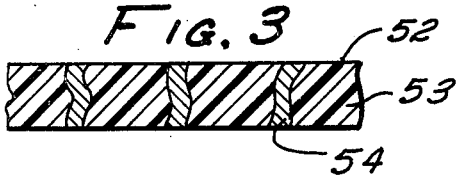
FIG. 3 is an enlarged, fragmentary cross-sectional view of uniaxially conductive material used in the arrangement shown in FIG. 2.

In the arrangement of FIGS. 2 and 3, the protective layer 24 has bubble or domed-shaped protrusions 55 formed therein and extending away from the surface 16 in opposed relationship to the switch contact regions. A conductive layer 56 is printed on the side of the protrusions 55 adjacent surface 16 so that as an actuator mechanism 58 forces a protrusion to invert and extend vertically downward into contact with the layer 52, the layer 52 is in turn forced through an aperture 20 into contact with the printed conductive switch patterns 30, 32 and 34. A switch closure pattern having multiple separate and isolated electrical engagement regions in thus provided between the high density of individual conductors 54 and the switch contact pattern 14 on the one hand and the conductive surface 56 on the other hand. A completed electrical path interconnecting the three switch contacts 30, 32 and 34 is thus provided. The multiple switch contacts, the resiliency of the material 52 and the force-distance hysteresis effect of the domed protrusions 55 provide a highly reliable switch closure which is nearly bounce free. It will be appreciated that because of the inherent resiliency of the material 52 in the perpendicular direction and the uniaxially conducting nature of the material 52, the material 52 may be provided as small disks or independent regions of material in the vicinity of the apertures 20 without need to extend across the entire surface of the separator 18. Switch contact closure can still occur only when a protrusion 55 is downwardly inverted.

The actuator 58 in the arrangement shown in FIG. 2 includes an actuator key 60, a follower 62, a follower spring 64, and a key spring 66. A coverplate 68 maintains the actuator assembly in the proper physical position and may be suitably secured to the other portions of the switch assembly. In this arrangement the follower 62 engages the domed protrusions 55 of each separate switch with the actuation force being transmitted from the actuator key 60 through the follower spring 64. This mechanism assures that a predetermined, uniform force is exerted upon the domed protrusion 55 which is protected from much stronger and potentially damaging forces with might result from direct contact by the actuator 60. The key spring 66 provides an independent restoring force for the actuator 60 to provide a desired human factors touch to the switch assembly.

It will be appreciated that a given particular arrangement of a keyboard switch assembly in accordance with the invention may employ any of a variety of actuator configurations with multiple conductive contact elements. Thus, while particular arrangements of a keyboard switch assembly in accordance with the invention has been shown and described to enable a person of ordinary skill in the art to make and use the invention, any modifications, variations or equivalent arrangements within the scope of the attached claims should be considered to be within the scope of the invention.

What is claimed is:

1. A switch assembly comprising:

a substrate having a conductive circuit pattern on a surface thereof, the circuit pattern defining switch contacts at switch contact regions of the substrate;

a generally planar, non-conductive spacer disposed adjacent the surface of the substrate in fixed, nonmoving relationship thereto, the spacer having apertures therethrough at locations opposite the switch contact regions of the substrate to provide communication through the spacer to the switch contacts;

a generally planar layer of resilient, multiple conductive contact material having a plurality of electrically isolated conductors extending between planar surfaces thereof, the layer having a resiliency in the plane thereof providing all of the return bias force tending to maintain the contacts at each switch region in an open condition and disposed adjacent the spacer on a side thereof opposite the substrate, the planar layer of multiple conductive contact material electrically engaging each of the switch contacts of each switch contact region at a large number of separate and isolated electrical engagement regions and providing switch closure electrical coupling between engaged switch contacts when forced through an aperture of the separator into engagement with the switch contacts of a switch contact region, the resiliency of the multiple conductive contact material providing an only source of positional bias tending to oppose engagement of the multiple conductive contact material with the switch contacts of a switch contact region;

a conductive layer disposed in opposed relationship to the switch contacts at each switch contact region between the planar layer and an actuator on a side of the planar layer opposite the spacer to provide electrical coupling between planar layer conductors during switch closure; and an actuator disposed in opposed relationship to the conductive layer of each spacer aperture to force the conductive layer into engagement with the conductors of the planar layer and to force the multiple conductive contact material through an aperture of the spacer, each actuator being biased toward a nonactuated, open contact position, and being coupled to force the multiple conductive contact material into switch closure engagement with the switch contacts to electrically close the switch contacts of a switch contact region in response to operator actuation.

2. The switch assembly according to claim 1 above, further comprising a protective layer of flexible material disposed adjacent the conductive layer on a side thereof opposite the spacer.

3. The switch assembly according to claim 2 above, wherein the protective layer has a plurality of deformable protrusions extending away from the spacer, each protrusion being disposed opposite a different aperture of the spacer to engage the conductive layer and apply a force through the conductive layer to force said multiple conductive contact material into switch closure engagement with switch contacts in response to operator actuation and having a force-distance hysteresis effect when actuated such that a force required to maintain switch closure is less than a force required to obtain switch closure.

4. The switch assembly according to claim 1 above, wherein the multiple conductive contact material comprises a resilient insulating material and a high density of individual, parallel spaced conductors extending through the insulating material in a direction perpendicular to the surface to provide switch closure conduction between the switch contacts at a switch contact region and the conductive layer when forced into engagement with the switch contacts.

5. A switch assembly comprising:

a substrate having a conductive circuit pattern on a surface thereof, the circuit pattern defining switch contacts at switch contact regions of the substrate;

a generally planar, non-conductive spacer disposed adjacent the surface of the substrate in fixed, non-moving relationship thereto, the spacer having apertures therethrough at locations opposite the switch contact regions of the substrate to provide communication through the spacer to the switch contacts;

a generally planar layer of resilient, multiple conductive contact material having a resiliency in the plane thereof providing all of the return bias force tending to maintain the contacts at each switch region in an open condition and disposed adjacent the spacer on a side thereof opposite the substrate, the planar layer of multiple conductive contact material electrically engaging each of the switch contacts of each contact region at a large number of separate and isolated electrical engagement regions when forced through an aperture of the separator into engagement with the switch contacts of a switch contact region, the resiliency of the multiple conductive contact material providing an only source of positional bias tending to oppose engagement of the multiple conductive contact material with the switch contacts of a switch contact region;

a protective layer of flexible material disposed adjacent the multiple conductive contact material on a side thereof opposite the spacer, the protective layer having a conductive surface adjacent the multiple contact conductive material to provide bridging contact between the conductors thereof when the conductors are forced into engagement with the switch contacts of a switch contact region; and an actuator disposed in opposed relationship to each spacer aperture to force the multiple conductive contact material through an aperture of the spacer and being adapted for operation in conjunction with the multiple conductive contact material to close the switch contacts of a switch contact region in response to operator actuation.

6. A switch assembly comprising:

a substrate having a conductive circuit pattern on a surface thereof, the circuit pattern defining switch contacts at switch contact regions of the subtrate;

a generally planar, non-conductive spacer disposed adjacent the surface of the substrate in fixed, non-moving relationship thereto, the spacer having apertures therethrough at locations opposite the switch contact regions of the substrate to provide communication through the spacer to the switch contacts;

a generally planar layer of resilient, multiple conductive contact material having a resiliency in the plane thereof providing all of the return bias force tending to maintain the contacts at each switch region in an open condition and disposed adjacent the spacer on a side thereof opposite the substrate, the planar layer of multiple conductive contact material electrically engaging each of the switch contacts of each switch contact region at a large number of separate and isolated electrical engagement regions when forced through an aperture of the separator into engagement with the switch contacts of a switch contact region, the resiliency of the multiple conductive contact material providing an only source of positional bias tending to oppose engagement of the multiple conductive contact material with the switch contacts of a switch contact region;

a protective layer of flexible material disposed adjacent the multiple conductive contact material on a side thereof opposite the spacer, the protective layer having a plurality of deformable protrusions extending away from the spacer, each protrusion being disposed opposite a different aperture of the spacer and having a force distance hysteresis effect when forced into engagement with the multiple conductive contact material, each protrusion having an electrically conductive surface on a side thereof adjacent the multiple conductive contact material to provide switch closure bridging contact between switch contacts at a region through the multiple conductive contact material when forced into engagement therewith; and an actuator disposed in opposed relationship to each spacer aperture to force the multiple conductive contact material through an aperture of the spacer and being adapted for operation in conjunction with the multiple conductive contact material to close the switch contacts of a switch contact region in response to operator actuation.

7. The switch assembly according to claim 6 above wherein the multiple conductive contact material is uniaxial conductive material having a high density of individual parallel metal conductors therein extending in a direction perpendicular to the surface of the substrate.

8. A switch assembly comprising:

a planar substrate having a conductive circuit pattern printed on a surface thereof, the circuit pattern defining a plurality of switch contacts for a plurality of switches;

a dielectric spacer disposed adjacent the surface and having an aperture therethrough opposite each contact defined by the circuit pattern;

a planar layer of uniaxially conducting material disposed to extend parallel to the surface and adjacent to each switch contact and compressing a resilient dielectric material and a plurality of parallel spaced conductors extending through the dielectric material perpendicular to the surface;

means defining a conductive surface opposite each plurality of switch contacts for each switch defined by the circuit pattern, each conductive surface providing a switch closure when forced toward the substrate surface to squeeze the planar layer of uniaxially conducting material between the conductive surface and a switch contact defined by the circuit pattern in opposed relationship thereto to provide switch closure circuit conduction between the plurality of switch contacts for a switch and the conductive surface.

9. The switch assembly according to claim 8 above, wherein the parallel spaced conductors of the uniaxially conducting material have a compressible resiliency in the conducting direction.

10. The switch assembly according to claim 8 above, wherein said means defining a conductive surface includes a plurality of protrusions, each extending in a direction away from the surface in opposed relationship to a switch contact thereon.

* * * * *

UNITED STATES PATENT AND TRADEMARK OFFICE

CERTIFICATE OF CORRECTION

PATENT NO. : 4,164,634

DATED : August 14, 1979

INVENTOR(S) : Michael N. Gilano

It is certified that error appears in the above-identified patent and that said Letters Patent are hereby corrected as shown below:

Column 3, line 66, "in" should read --is--. Column 4, line 28, "with" should read --which--. Column 8, line 3, "compressing" should read --comprising--.

Signed and Sealed this

*Twentieth* Day of *November 1979*

[SEAL]

*Attest:*

RUTH C. MASON
*Attesting Officer*

LUTRELLE F. PARKER
*Acting Commissioner of Patents and Trademarks*